US011213156B2

(12) United States Patent
Morris

(10) Patent No.: US 11,213,156 B2
(45) Date of Patent: Jan. 4, 2022

(54) DRONE PACKAGE DROP ADAPTER

(71) Applicant: Greg Morris Photographer LLC, Brooklyn, NY (US)

(72) Inventor: Gregory Morris, Brooklyn, NY (US)

(73) Assignee: Greg Morris Photographer LLC, Brooklyn, NY (US)

( * ) Notice: Subject to any disclaimer, the term of this patent is extended or adjusted under 35 U.S.C. 154(b) by 510 days.

(21) Appl. No.: 16/095,479

(22) PCT Filed: Jul. 17, 2018

(86) PCT No.: PCT/US2018/042561
§ 371 (c)(1),
(2) Date: Oct. 22, 2018

(87) PCT Pub. No.: WO2020/018082
PCT Pub. Date: Jan. 23, 2020

(65) Prior Publication Data

US 2021/0038005 A1 Feb. 11, 2021

(51) Int. Cl.

| | |
|---|---|
| ***A47G 29/12*** | (2006.01) |
| ***A47G 29/30*** | (2006.01) |
| ***A47G 29/20*** | (2006.01) |
| ***A47G 29/14*** | (2006.01) |

(52) U.S. Cl.
CPC ..... *A47G 29/12095* (2017.08); *A47G 29/14* (2013.01); *A47G 29/20* (2013.01); *A47G 29/30* (2013.01); *A47G 2029/145* (2013.01); *A47G 2029/149* (2013.01)

(58) Field of Classification Search
CPC .. A47G 29/12095; A47G 29/30; A47G 29/14; A47G 29/16; A47G 29/20; A47G 29/28; A47G 29/141; A47G 2029/145; A47G 2029/148; A47G 2029/149; A47G 29/22; G06Q 50/28; G06Q 10/083; G06Q 10/0832; B64C 39/02; B64C 39/024; B64C 2201/128; B64D 1/02; B64D 1/12; B64F 1/32; B65G 2201/0285
USPC ..... 232/1 E, 19, 44, 45, 43.1, 43.5; 244/114 R, 118.1, 118.2, 137.1, 137.4; 705/330; 340/569; 193/8, 27, 33
See application file for complete search history.

(56) References Cited

U.S. PATENT DOCUMENTS

| | | | | |
|---|---|---|---|---|
| 9,840,340 | B2 * | 12/2017 | O'Toole | B60L 53/68 |
| 9,975,651 | B1 * | 5/2018 | Eck | B65G 67/04 |
| 10,026,054 | B1 * | 7/2018 | Staton | G06Q 10/0832 |
| 10,351,261 | B1 * | 7/2019 | Bryant | B64F 1/362 |
| 10,919,702 | B1 * | 2/2021 | Berta | B65G 11/183 |

(Continued)

*Primary Examiner* — William L Miller
(74) *Attorney, Agent, or Firm* — Stoyanov Law PLLC; Roy Chan

(57) ABSTRACT

A drone package drop adapter has a first chute section, a second chute section, an inlet, and a shaft. The first chute section has a first ramp and a first drop. The second chute section has a second ramp, a second connector, and a second drop. The first ramp has a plurality of first openings, a first ramp top edge, and a first ramp bottom edge. The first drop has a first drop top edge and a first drop bottom edge. The second ramp has a plurality of second openings, a second ramp top edge, and a second ramp bottom edge. The second connector has a second connector top edge and a second connector bottom edge. The second drop has a second drop top edge and a second drop bottom edge.

36 Claims, 7 Drawing Sheets

(56) References Cited

U.S. PATENT DOCUMENTS

| | | | | |
|---|---|---|---|---|
| 2015/0158599 | A1* | 6/2015 | Sisko | B64F 1/20 244/114 R |
| 2017/0091710 | A1* | 3/2017 | Van Dyke | H04L 67/42 |
| 2017/0305575 | A1* | 10/2017 | Bash | B64F 1/32 |
| 2018/0186454 | A1* | 7/2018 | Luckay | G05D 1/0094 |
| 2019/0152701 | A1* | 5/2019 | Eck | B65G 1/0464 |
| 2019/0300202 | A1* | 10/2019 | High | G05B 15/02 |
| 2020/0093310 | A1* | 3/2020 | Hauck | A47G 29/26 |
| 2020/0146489 | A1* | 5/2020 | Orton | A47G 29/20 |

* cited by examiner

DRONE PACKAGE DROP ADAPTER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention is related to an adapter to receive packages delivered by drones.

BRIEF SUMMARY OF THE INVENTION

In an embodiment of the present invention, a drone package drop adapter comprises a first chute section, a second chute section, an inlet, and, a shaft. The first chute section comprises a first ramp, and a first drop. The second chute section comprises a second ramp, a second connector, and a second drop. The first ramp has a plurality of first openings. The first ramp comprises a first ramp top edge, and a first ramp bottom edge. The first drop comprises a first drop top edge, and a first drop bottom edge. The first side is attached to the first ramp top edge; the first ramp bottom edge is attached to the first drop top edge; the first drop bottom edge is attached to the bottom; and, the first ramp is sloped downward from the first side towards the second side. The second ramp has a plurality of second openings. The second ramp comprises a second ramp top edge, and a second ramp bottom edge. The second connector comprises a second connector top edge, and a second connector bottom edge. The second drop comprises a second drop top edge, and a second drop bottom edge. The second side is attached to the second ramp top edge; the second ramp bottom edge is attached to the second connector top edge; the second connector bottom edge is attached to the second drop top edge; and, the second drop bottom edge is attached to the bottom. The inlet and the shaft are formed between the first chute section and the second chute section.

In another embodiment of the present invention, a drone package drop adapter comprises a body, a first chute section, a second chute section, a third chute section, at least one collector compartment, an inlet, and, a shaft. The body comprises a first side, a second side, and a bottom. The first chute section comprises a first ramp, a first drop, a first connector, and a first secondary drop. The second chute section comprises a second ramp, a second connector, and a second drop. The third chute section comprises a third ramp, a third connector, and a third drop. The first ramp has a plurality of first openings. The first ramp comprises a first ramp top edge, and a first ramp bottom edge. The first drop comprises a first drop top edge, and a first drop bottom edge. The first connector comprises a first connector top edge, and a first connector bottom edge. The first secondary drop comprises a first secondary drop top edge, and a first secondary drop bottom edge. The first side is attached to the first ramp top edge; the first ramp bottom edge is attached to the first drop top edge; the first drop bottom edge is attached to the first connector top edge; the first connector bottom edge is attached to the first secondary top edge; the first secondary bottom edge is attached to the bottom; and, the first ramp is sloped downward from the first side towards the second side. The second ramp has a plurality of second openings. The second ramp comprises a second ramp top edge, and a second ramp bottom edge. The second connector comprises a second connector top edge, and a second connector bottom edge. The second drop comprises a second drop top edge, and a second drop bottom edge. The third ramp has a plurality of third openings. The third ramp comprises a third ramp top edge, and a third ramp bottom edge. The third connector comprises a third connector top edge, and a third connector bottom edge. The third drop comprises a third drop top edge, and a third drop bottom edge. The second side is attached to the second ramp top edge; the second ramp bottom edge is attached to the second connector top edge; the second connector bottom edge is attached to the second drop top edge; the second drop bottom edge is attached the third ramp top edge; the third ramp bottom edge is attached to the third connector top edge; the third connector bottom edge is attached to the third drop top edge; the third drop bottom edge is attached to the bottom; and, wherein the third ramp is sloped downward from second side towards the first side. The at the least one collector compartment is formed between the first chute section, the first side and the bottom, and between the second chute section, the third chute section, the second side and the bottom. The inlet and the shaft are formed between the first chute section, the second chute section and the third chute section.

In another embodiment of the present invention, the second ramp bottom edge extends towards the first side. The second ramp bottom edge extends over the first ramp. The second ramp bottom edge extends beyond the first ramp bottom edge In yet another embodiment of the present invention, the drone package drop adapter further comprises a body, at least one collector compartment, and at least one drain. The body comprises a first side, a second side, and a bottom. The at least one collector compartment is formed between the first chute section, the first side and the bottom, and between the second chute section, the second side and the bottom. The at least one drain is in communication with the at least one collector compartment through the body.

In another embodiment of the present invention, the second ramp is sloped downward from the second side towards the first side.

In yet another embodiment of the present invention, the second connector is sloped downward from the second ramp bottom edge towards the second side.

In another embodiment of the present invention, the drone package drop adapter further comprises at least one mounting flange.

In yet another embodiment of the present invention, the drone package drop adapter further comprises a plurality of positioning devices.

In another embodiment of the present invention, the body, the first chute section and the second chute section are made of stainless steel.

In yet another embodiment of the present invention, the drone package drop adapter further comprises an aperture. The aperture is in communication with the shaft.

In another embodiment of the present invention, the drone package drop adapter further comprises a location device.

In yet another embodiment of the present invention, the body further comprises at least one access panel.

In another embodiment of the present invention, the third ramp is sloped downward from the second drop bottom edge towards the first side.

In yet another embodiment of the present invention, the drone package drop adapter further comprises a trap door. The trap door is hingedly attached to the shaft.

In another embodiment of the present invention, the first ramp further comprises a first ramp conveyor; and, the second ramp further comprises a second ramp conveyor.

In yet another embodiment of the present invention, the third ramp further comprises a third ramp conveyor.

In another embodiment of the present invention, the drone package drop adapter further comprises at least one sensor.

In yet another embodiment of the present invention, the sensor is a photosensor.

In another embodiment of the present invention, the sensor is a water level sensor.

BRIEF DESCRIPTION OF THE SEVERAL VIEWS OF THE DRAWING

The advantages and features of the present invention will be better understood as the following description is read in conjunction with the accompanying drawings, wherein.

Figure 1:
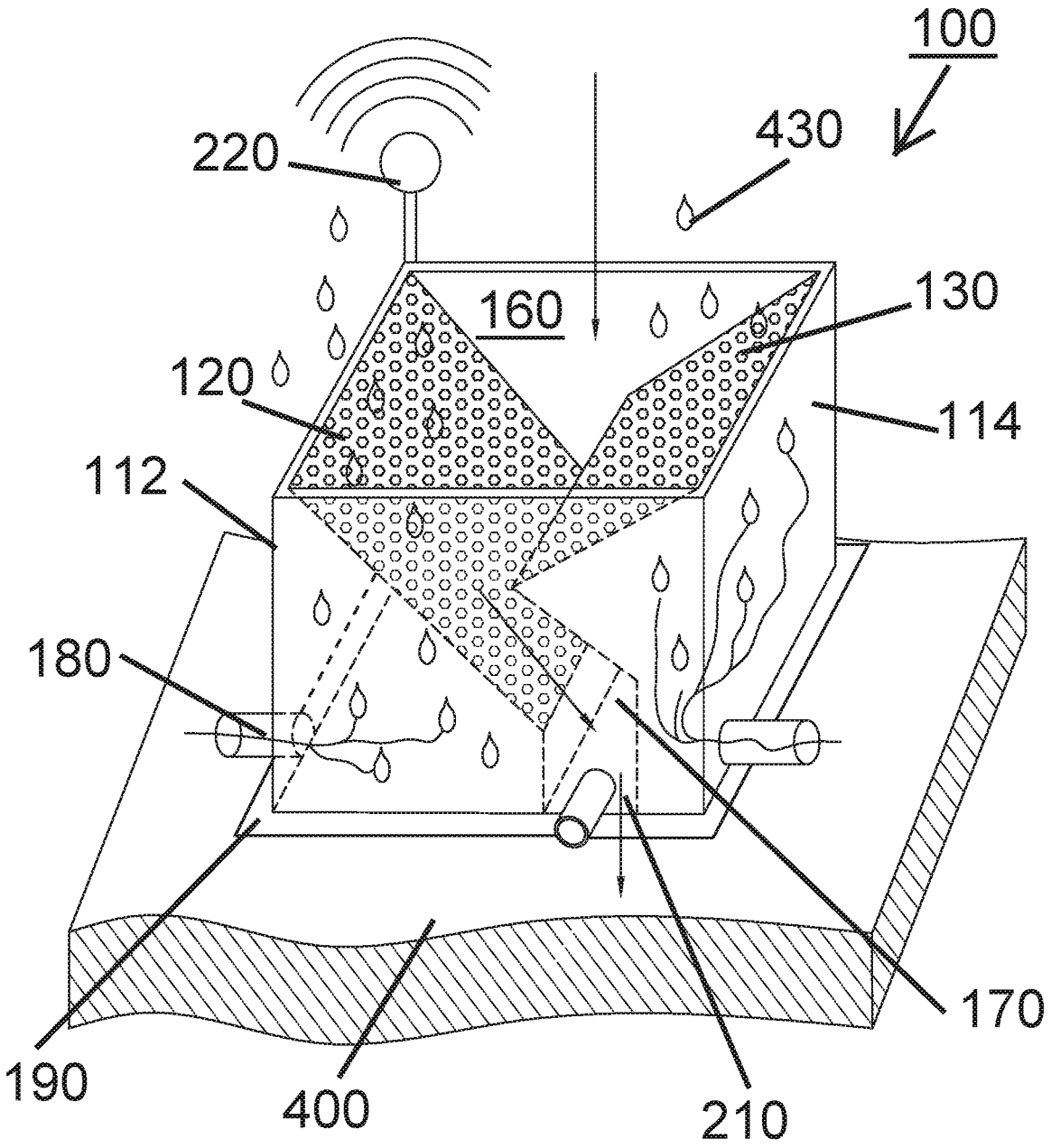
FIG. 1 is a perspective-sectional view of an embodiment of the present invention.

For clarity purposes, all reference numerals may not be included in every figure.

DETAILED DESCRIPTION OF THE INVENTION

In a preferred embodiment of the present invention, the drone package drop adapter 100 may be positioned on a roof 400 of a building to accept packages 420 delivered by a drone. A drone carrying packages 420 positions over the inlet 160 of the drone package drop adapter 100, and drops a package 420. The package 420 lands on the first chute section 120 of the drone package drop adapter 100, and under the force of gravity is transferred down the shaft 170. The package 420 makes its way through the shaft 170 to the end of the shaft 170. The end of the shaft 170 may connect to a package collector compartment 300, such as a cart, package room, mailroom, or other structure or container where the package 420 is transferred from the end of the shaft 170. The package collection compartment 300 may sit on top of the roof 400 below the drone package drop adapter 100, or it may be under the roof 400, in which case the end of the shaft 170 may extend through a hole 410 on the roof 400.

The ramps 122, 132, 142 of the drone package drop adapter 100 have openings 122*c*, 132*c*, 142*c* through them that allow water, snow, debris, and other particles to drop through the ramps 122, 132, 142 into a collector compartment 150. Liquids may be drained from the collector compartment 150 through drains 180, or can be cleaned through an access panel 118.

Figure 2:
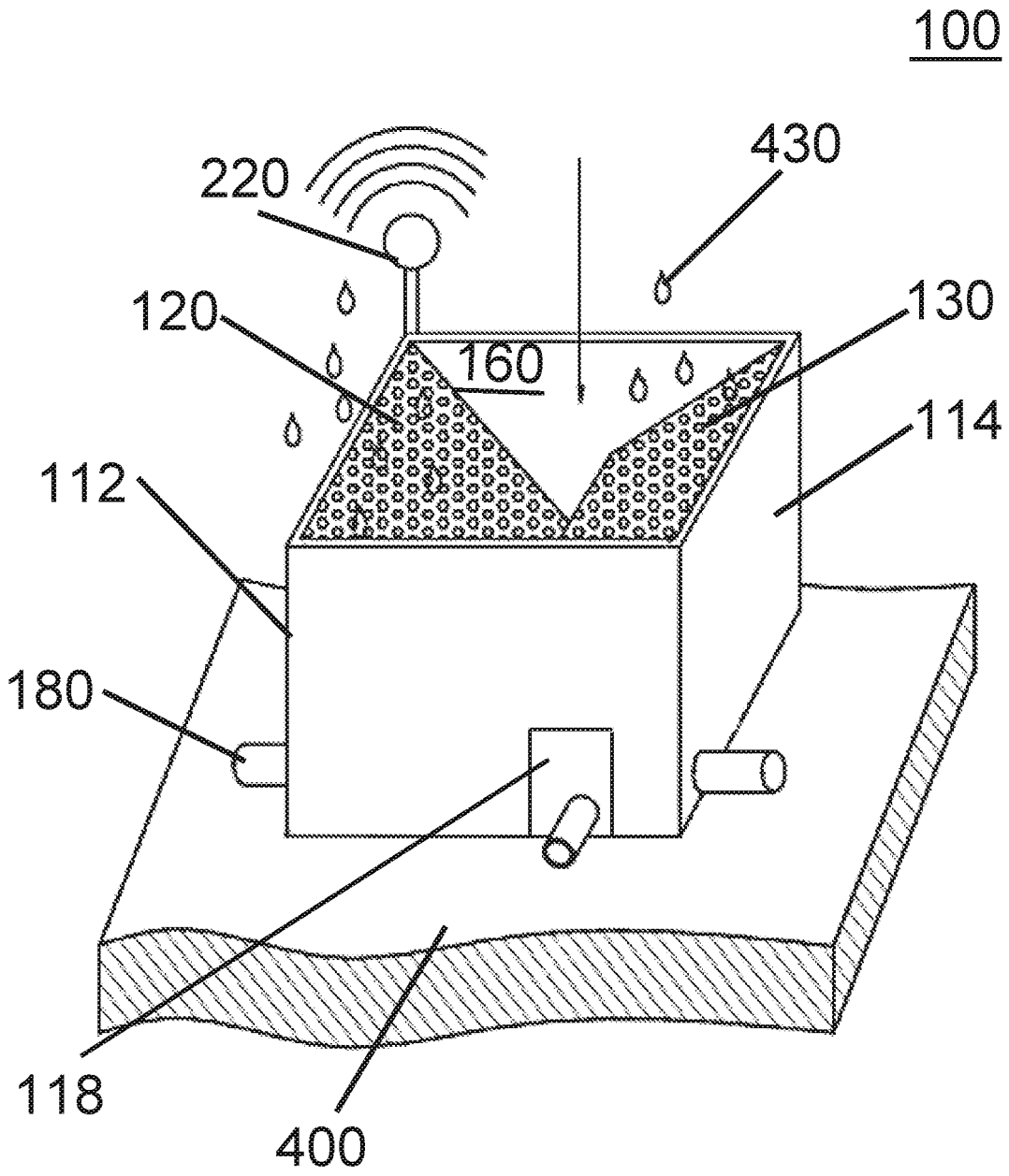
FIG. 2 is a perspective view of an embodiment of the present invention.
Figure 5:
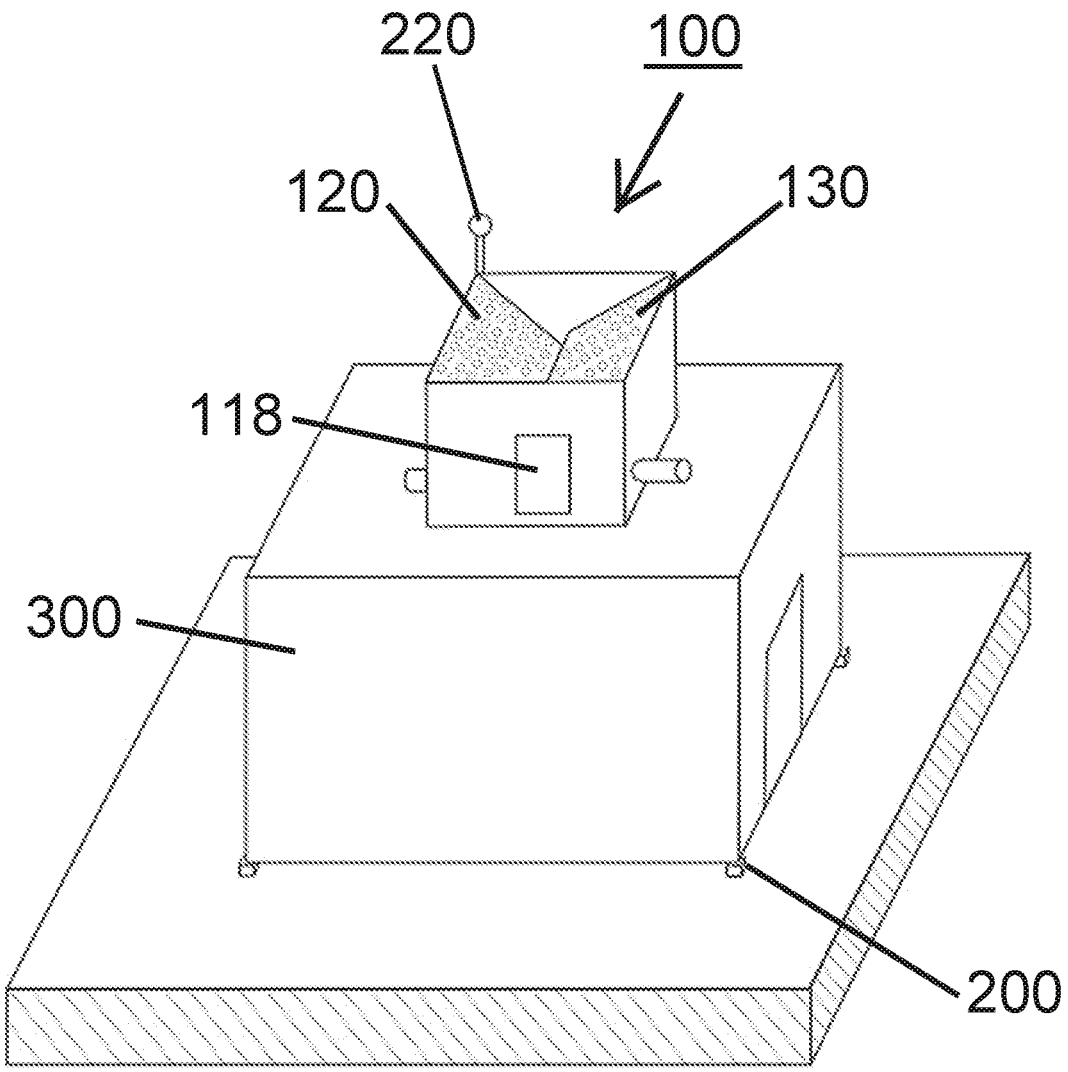
FIG. 5 is a perspective view of an embodiment of the present invention.
Figure 6:
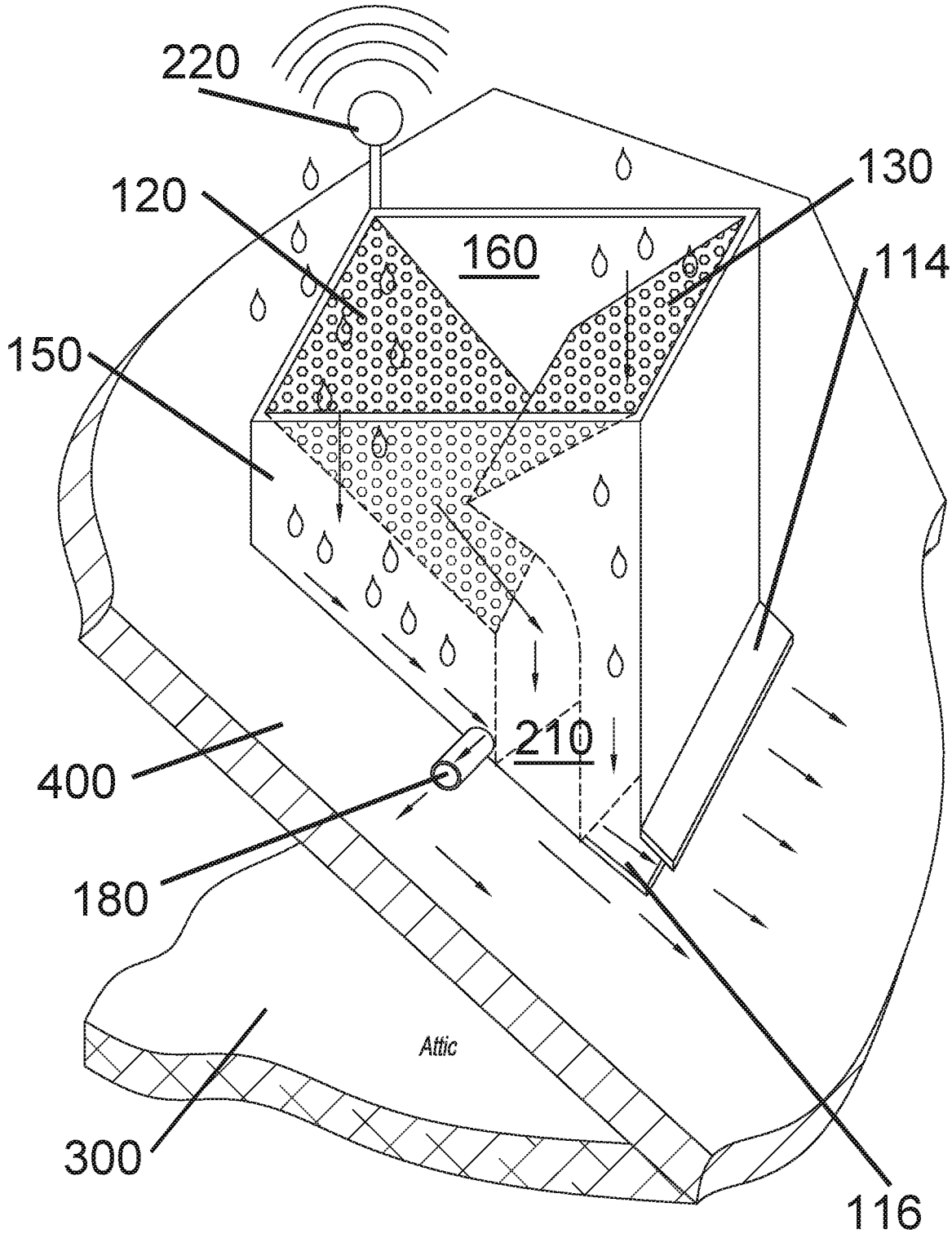
FIG. 6 is a perspective-sectional view of an embodiment of the present invention.

Various embodiments of the invention can be utilized by placing them on a flat surface, such as a flat roof 400 as shown in FIGS. 1, 2 and 5, slanted roof 400 as shown on FIG. 6, or any other surface where a drone may deliver a package 420.

As illustrated in the figures, a drone package drop adapter 100 may comprise a body 110, a first chute section 120, a second chute section 130, at least one collector compartment 150, an inlet 160, and, a shaft 170. The body 110 comprises a first side 112, a second side 114, and a bottom 116. The first chute section 120 comprises a first ramp 122, and a first drop 124. The second chute section 130 comprises a second ramp 132, a second connector 134, and a second drop 136.

Figure 4:
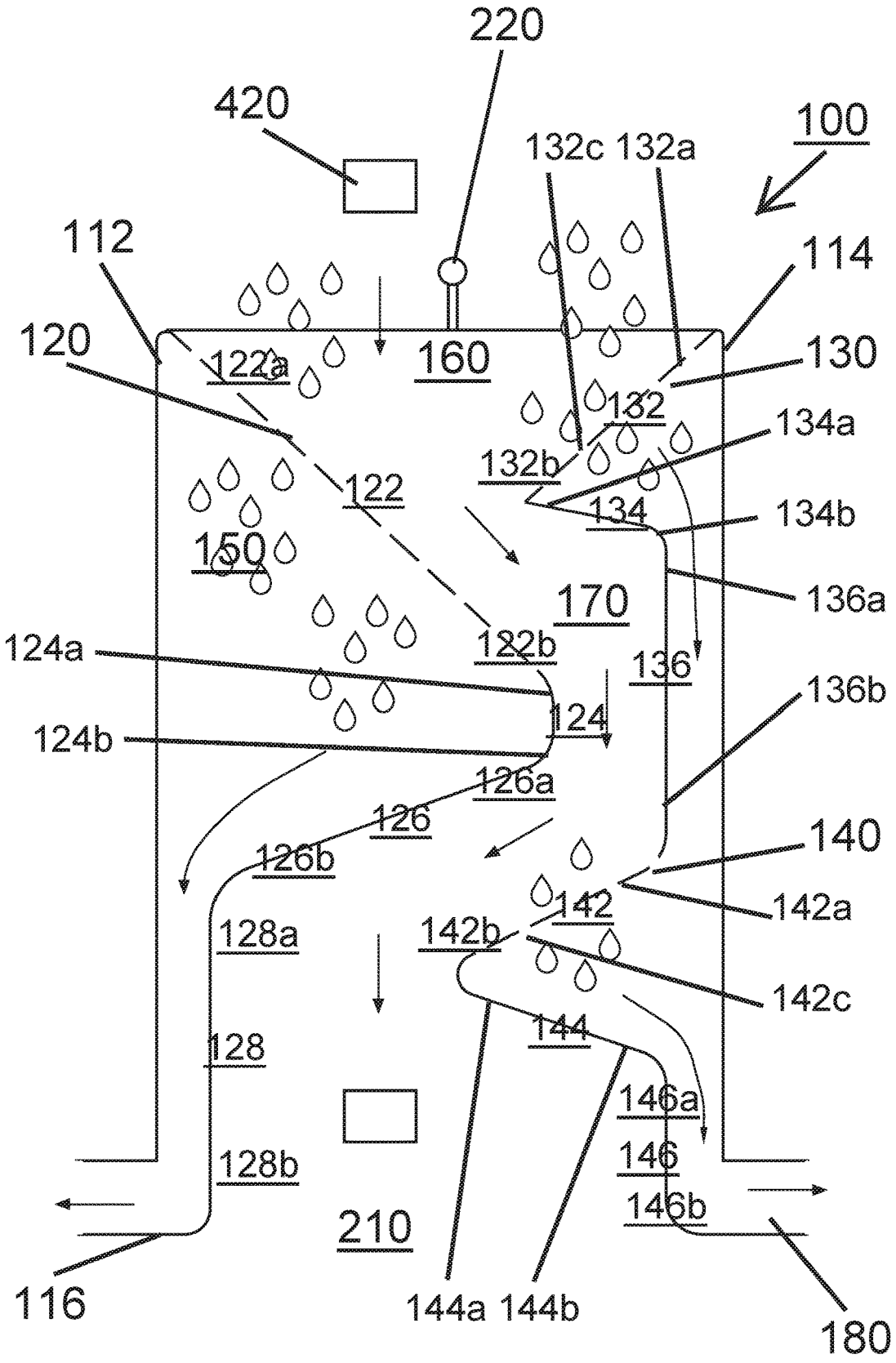
FIG. 4 is a cross-sectional view of an embodiment of the present invention.

As illustrated in FIG. 4, the first ramp 122 has a plurality of first openings 122*c*. The first ramp 122 comprises a first ramp top edge 122*a*, and a first ramp bottom edge 122*b*. The first drop 124 comprises a first drop top edge 124*a*, and a first drop bottom edge 124*b*. The first side 112 is attached to the first ramp top edge 122*a*; the first ramp bottom edge 122*b* is attached to the first drop top edge 124*a*; the first drop bottom edge 124*b* is attached to the bottom 116; and, the first ramp 122 may be sloped downward from the first side 112 towards the second side 114.

The second ramp 132 has a plurality of second openings 132*c*. The second ramp 132 comprises a second ramp top edge 132*a*, and a second ramp bottom edge 132*b*. The second connector 134 comprises a second connector top edge 134*a*, and a second connector bottom edge 134*b*. The second drop 136 comprises a second drop top edge 136*a*, and a second drop bottom edge 136*b*. The second side 114 is attached to the second ramp top edge 132*a*; the second ramp bottom edge 132*b* is attached to the second connector top edge 134*a*; the second connector bottom edge 134*b* is attached to the second drop top edge 136*a*; and, the second drop bottom edge 136*b* is attached to the bottom 116.

A package 420 that is dropped on the second ramp 132 will be transported down the slope of the second ramp 132, and eventually drop onto the first ramp 122.

Preferably, the second ramp bottom edge 132*a* extends towards the first side 112, over the first ramp 122, and beyond the first ramp bottom edge 122*b* to reduce the amount or rain, snow or other debris that may enter the shaft 170.

The at the least one collector compartment 150 is formed between the first chute section 120, the first side 112 and the bottom 116, and between the second chute section 130, the second side 114 and the bottom 116.

The inlet 160 and the shaft 170 are formed between the first chute section 120 and the second chute section 130, as illustrated in FIG. 1. The inlet 160 is the location where the package 420 enters the drone package drop adapter 100. The package 420 continues through the inlet 160 into the shaft 170. The first chute section 120 and the second chute section 130 are configured to protect the package 420 from the elements.

In another embodiment of the present invention, as illustrated in FIG. 4, a drone package drop adapter 100 comprises a body 110, a first chute section 120, a second chute section 130, a third chute section 140, at least one collector compartment 150, an inlet 160, and, a shaft 170. The body 110 comprises a first side 112, a second side 114, and a bottom 116. The first chute section 120 comprises a first ramp 122, a first drop 124, a first connector 126, and a first secondary drop 128. The second chute section 130 comprises a second ramp 132, a second connector 134, and a second drop 136. The third chute section 140 comprises a third ramp 142, a third connector 144, and a third drop 146.

The first ramp 122 has a plurality of first openings 122*c*. The first ramp 122 comprises a first ramp top edge 122*a*, and a first ramp bottom edge 122*b*. The first drop 124 comprises a first drop top edge 124*a*, and a first drop bottom edge 124*b*. The first connector 126 comprises a first connector top edge 126*a*, and a first connector bottom edge 126*b*. The first secondary drop 128 comprises a first secondary drop top edge 128*a*, and a first secondary drop bottom edge 128*b*.

The first side 112 is attached to the first ramp top edge 122*a*; the first ramp bottom edge 122*b* is attached to the first drop top edge 124*a*; the first drop bottom edge 124*b* is attached to the first connector top edge 126*a*; the first connector bottom edge 126*a* is attached to the first secondary top edge 128*a*; the first secondary bottom edge 128*b* is attached to the bottom 116. The first ramp 122 may be sloped downward from the first side 112 towards the second side 114.

The second ramp 132 has a plurality of second openings 132*c*. The second ramp 132 comprises a second ramp top edge 132*a*, and a second ramp bottom edge 132*b*. The second connector 134 comprises a second connector top edge 134*a*, and a second connector bottom edge 134*b*. The second drop 136 comprises a second drop top edge 136*a*, and a second drop bottom edge 136*b*.

The third ramp 142 has a plurality of third openings 142*c*. The third ramp 142 comprises a third ramp top edge 142*a*, and a third ramp bottom edge 142*b*. The third connector 144 comprises a third connector top edge 144*a*, and a third connector bottom edge 144*b*. The third drop 146 comprises a third drop top edge 146*a*, and a third drop bottom edge 146*b*.

The second side 114 is attached to the second ramp top edge 132*a*; the second ramp bottom edge 132*b* is attached to the second connector top edge 134*a*; the second connector bottom edge 134*b* is attached to the second drop top edge 136*a*; the second drop bottom edge 136*b* is attached the third ramp top edge 142*a*; the third ramp bottom edge 142*b* is attached to the third connector top edge 144*a*; the third connector bottom edge 144*b* is attached to the third drop top edge 146*a*; the third drop bottom edge 146*b* is attached to the bottom 116; and, the third ramp 142 is sloped downward from second side 114 towards the first side 112.

The at the least one collector compartment 150 is formed between the first chute section 120, the first side 112 and the bottom 116, and between the second chute section 130, the third chute section 140, the second side 114 and the bottom 116.

The inlet 160 and the shaft 170 are formed between the first chute section 120, the second chute section 130 and the third chute section 140.

In some embodiments, as illustrated in the figures, the drone package drop adapter 100 may further comprise at least one drain 180. The at least one drain 180 is in communication with the at least one collector compartment 150 through the body 110.

In some embodiments, the second ramp 132 may be sloped downward from the second side 114 towards the first side 112.

In some embodiments, the second connector 134 may be sloped downward from the second ramp bottom edge 132*b* towards the second side 114, as illustrated in FIG. 4.

In some embodiments, the drone package drop adapter 100 may further comprise at least one mounting flange 190, as illustrated in FIGS. 1 and 6. The at least one mounting flange 190 may be utilized for a drone package drop adapter 100 that may be affixed or mounted to a roof 400.

In some embodiments, the drone package drop adapter 100 may further comprise a plurality of positioning devices 200, as illustrated in FIG. 5. The plurality of positioning devices 200 may be utilized for a drone package drop adapter 100 that may be portable, or that may be used without the need for a hole in the roof 400. Positioning devices 200 may include casters, anchors, and other devices that allow the drone package drop adapter 100 to be securely positioned in a desired location.

In some embodiments, the body 110, the first chute section 120, the second chute section 130 and the third chute section 140 may be made of stainless steel. As the drone package drop adapter 100 may be exposed to the elements, it may be advantageous to utilize a weather (UV, rain, snow, sleet, etc.) resistant material, such as stainless steel, certain plastics, resins, and other materials that will be known to a knowledgeable person.

Figure 3:
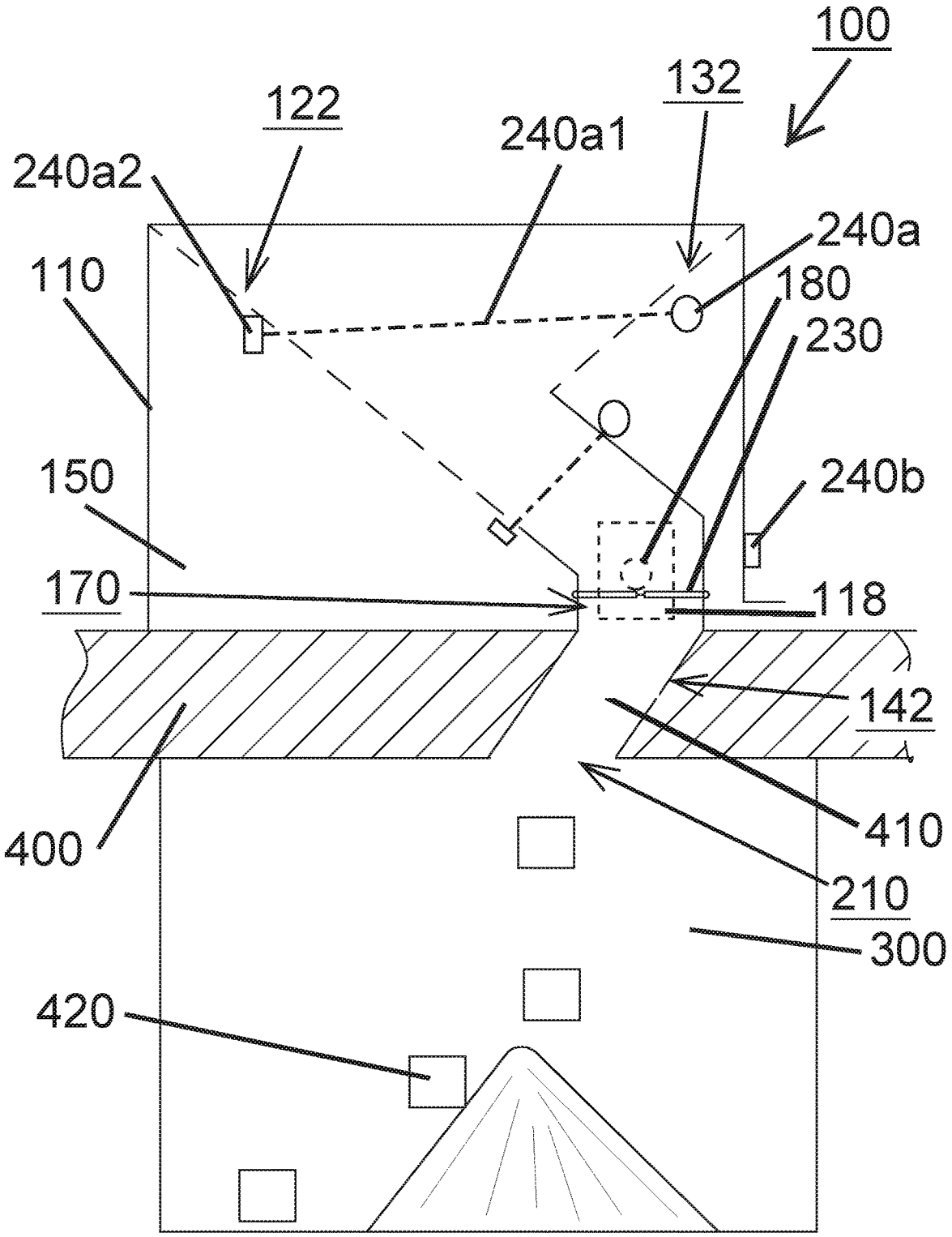
FIG. 3 is a cross-sectional view of an embodiment of the present invention.

In some embodiments, as illustrated in FIGS. 1, 4 and 6, the drone package drop adapter 100 may further comprise an aperture 210. The aperture 210 is in communication with the shaft 170. In this embodiment, the drone package drop adapter 100 may be mounted to a package collection compartment 300 (as illustrated in FIGS. 3 and 5), such as a cart, container, box, shed, room under the roof, attic, or similar device or structure. The aperture 210 allows the package 420 to proceed through the shaft 170, through the aperture 210, and into the package collection compartment 300. Similarly, as illustrated in FIG. 3, the drone package drop adapter 100 may be mounted to a roof 400, where the roof 400 may have a hole 410, such that the aperture 210 is positioned on top of the hole 410, and a tube is connected to the hole. Then, the aperture 210 allows the package to proceed through the shaft 170, through the aperture 210, through the hole 410 in the roof 400, through the tube and into a package collection compartment 300, such as a package storage room, mailroom, or similar structure. The package 420 can also be transferred from through the aperture 210, through the hole 410 in the roof 400, through the tube to a system that allows delivery of the package to a specific location within a building, such as an apartment.

FIG. 5 illustrates an embodiment of the current invention in which the drone package drop adapter 100 and a package collection compartment 300 can be provided as single unit that can be positioned on top of a roof 400 or any other surface. The drone package drop adapter 100 may also be provided separately to be positioned on top of an opening of a package collection compartment 300 provided by the user. These embodiments of the drone package drop adapter 100 are very portable and may be used anywhere. If the positioning devices 200 are casters or wheels, then the drone package drop adapter 100 and the package collection compartment 300 (with or without a package 420 within the package collection compartment 300) may be moved to different locations. The positioning devices 200 could also be anchors so that the drone package drop adapter 100 may be removably secured in a specific location.

In some embodiments, the drone package drop adapter 100 may further comprise a location device 220, as illustrated in FIGS. 1, 2, 4, 5 and 6. The location device 220 may facilitate the drone locating the drone package drop adapter 100. The location device 220 may comprise a GPS or other beacon that identifies the location of the drone package drop adapter 100. The location device 220 may comprise a RFID identification system (e.g., RFID tag) or other identification instrumentality that can identify the drone package drop adapter 100.

In some embodiments, the body 110 may further comprise at least one access panel 118, as illustrated in FIGS. 2 and 5. The access panel 118 may be removable or it may be attached with hinges to the body 110 and can be opened like a door. In some embodiments, the at least one access panel 118 may be located on the body 110 and when opened, the at least one access panel 118 may be in communication with the shaft 170. The at least one access panel 118 may be opened to allow retrieval of the package 420 if a package 420 gets stuck in the shaft 170. In other embodiments, the at least one access panel 118 may be located on the body 110 and when opened, the at least one access panel 118 may be in communication with the at least one collector compartment 150. The at least one access panel 118 may be opened to allow maintenance of the at least one collector compartment 150. Some embodiments may have both of these types of access panels 118. Furthermore, embodiments may have multiple access panels for retrieving a package 420 and/or maintenance of the collector compartment 150, In some embodiments, the third ramp 142 may be sloped downward from the second drop bottom edge 136*b* towards the first side 112, as illustrated in FIG. 4.

The first ramp 122 may be sloped downward from the first side 112 towards the second side 114, as illustrated in the figures. The second ramp 132 may be sloped downward from the second side 114 towards the first side 112. The second connector 134 may be sloped downward from the second ramp bottom edge 132*b* towards the second side 114, as illustrated in FIG. 4. The sloping may aid the reception of a package 420 into the drone package drop adapter 100 and the formation of the inlet 160 and the shaft 170. The term "towards" refers to the direction and orientation of the sloping, not that it reaches the object. For example, the first ramp 122 may be sloped downward from the first side 112 towards the second side 114 means that the first ramp 122 slopes from the first side 112 towards the second side 114, but the first ramp 122 does not reach the second side 114.

Some embodiments may have a trap door 230, as illustrated in FIG. 3, that entirely or partially may block the shaft 170 when no package 420 is being transferred down the shaft 170. The trap door 230 prevents or reduces rodents, rain, snow, and other debris from entering into the package collection compartment 300. The trap door 230 can be a single piece, two pieces as shown in FIG. 3, or any number of pieces. The trap door 230 can be attached to one or more of the walls of the shaft 170. The trap door 230 can use a hinge like mechanism that allows the trap door 230 to open and allow a package 420 to be transferred through the shaft 170 and close when loaded. The hinge like mechanism may be operated by a spring that will open under the weight of a package 420 and close when the package 420 is no longer on the trap door 230, or the trap door 230 may be operated by an actuator that detects when a package 420 is present in the shaft 170 and opens the trap door 230 to allow the package 420 to be transferred. The actuator can be a motor, solenoid valve, or any other device able to open the trap door 230 to pass a package 420 and close the trap door 230 when no package 420 is present.

Some embodiments may have one collector compartment 150, while other embodiments may have more than one collector compartment 150. For example, each chute section 120, 130, 140 may form its own collector compartment 150; alternatively, the collector compartments 150 formed may all be in communication with each other resulting in one large collector compartment 150. As illustrated in FIG. 4, the first ramp 122 has a plurality of first openings 122*c*, the second ramp 132 has a plurality of second openings 132*c*, and the third ramp 142 has a plurality of third openings 142*c*. In the event of precipitation (rain, snow, etc.) and/or wind, water and/or debris may fall onto the drone package drop adapter 100. The plurality of first, second and third openings 122*c*, 132*c*, 142*c* permit the water and debris to fall into the collector compartment 150, and not into the shaft 170, where the package 420 would be located.

As illustrated in figures, some embodiments may have at least one drain 180. If any water and/or debris fall into the collector compartment 150, the drain 180 may reduce, prevent or remove any build-up of water and debris. In embodiments having one collector compartment 150, one drain 180 may be sufficient; however, more than one drain 180 may be beneficial. In embodiments with more than one collector compartment 150, at least one drain 180 may be utilized to accommodate each collector compartment 150. The drain 180 may comprise of an opening through the wall of the collector compartment 150, a tube, a pump, or other devices capable of removing liquids or other debris. The drain 180, may also be an opening formed between sides 112 or 114 and the bottom 116, as shown in FIG. 6.

Embodiments with a trap door 230 may have at least on drain 180 and/or an access panel 118 in communication with the shaft 170 to reduce, prevent or remove any build-up of water and debris.

Figure 7:
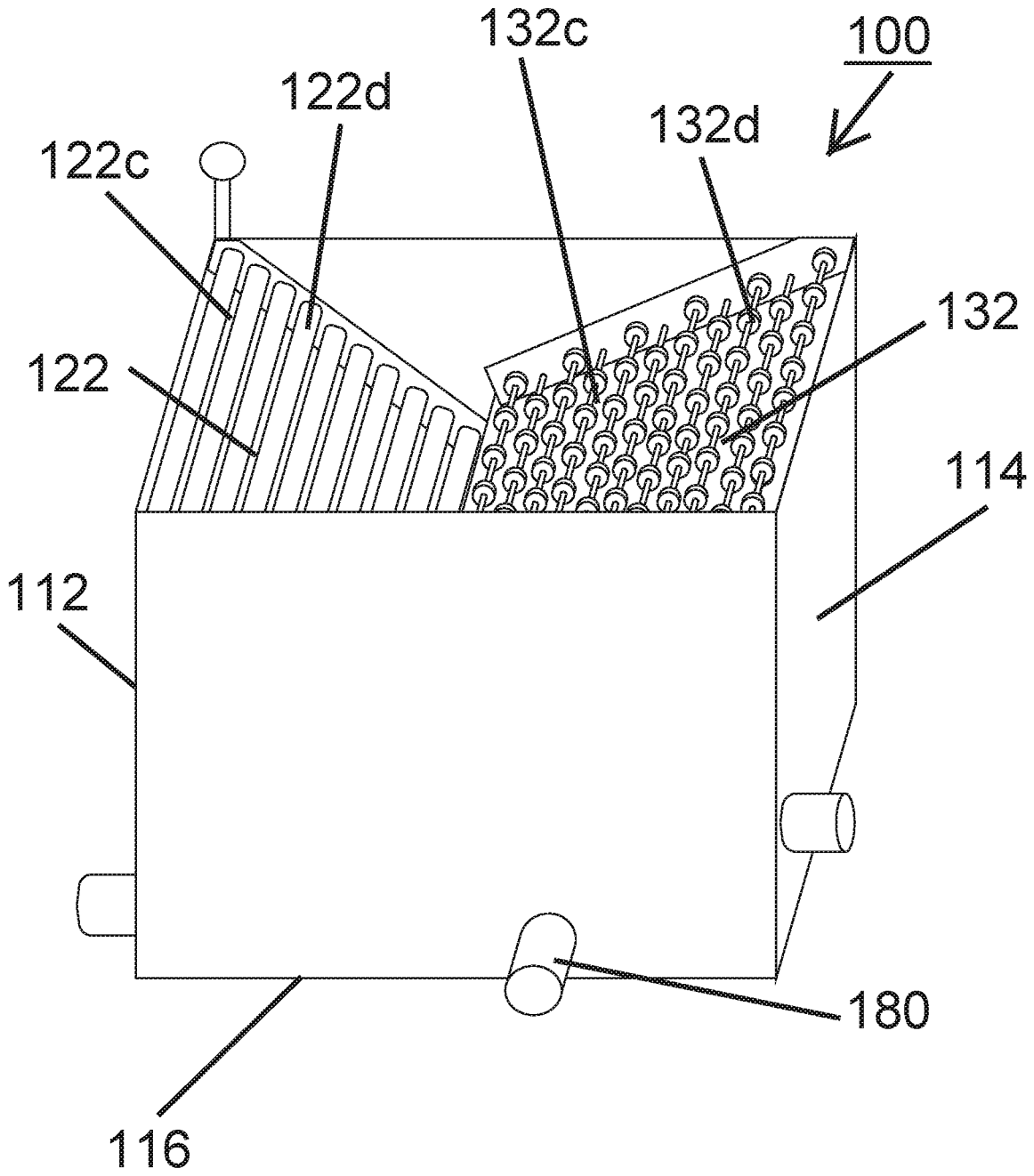
FIG. 7 is a perspective view of an embodiment of the present invention.

Ramps 122, 132, 142 may be made from the same materials as the body 110, the first chute section 120, the second chute section 130 and the third chute section 140, for example stainless steel, plastic, resin or any other materials suitable for using outdoors. Ramps 122, 132, 142 may be positioned with different slopes to facilitate gravitational package transfer, and may be coated with thin films of materials that reduce friction, such as graphite, Teflon, resins, polymers, metals, and others. Ramps 122, 132, 142 may be flat, or concave in such way that they facilitate the gravitational transfer of packages down the ramps 122, 132, 142 and to the shaft 170. As illustrated in FIG. 7, ramps 122, 132, 142 may also comprise gravitational conveyors with rollers 122*d*, skate-wheels 132*d*, or similar. Ramps 122, 132, 142 may also be spiral.

Openings 122*c*, 132*c*, 142*c* may be perforations through the ramps 122, 132, 142, holes (such as when the ramps 122, 132, 142 are made of a grate, sieve, mesh, or similar material), or as illustrated in FIG. 7, the openings 122*c*, 132*c*, 142*c* may be formed between the rollers, skate-wheels, or other hardware of a conveyor.

To reduce snow and ice accumulation, especially in colder climates, in an embodiment of the invention, the drone package adapter 100 may also comprise heating elements that provide heat to the chute sections 120, 130, 140. The heating elements may be electrical or gas powered, and may have independent energy source, or may be connected to the building's electric or heating system.

In another embodiment the drone package adapter 100 may comprise an openable shield that covers the top of the drone package adapter 100 when no package is being delivered. The shield may be automatically controlled to open when a package will be delivered to the drone package adapter 100, and remain closed otherwise. The shield can be opened using various actuators, such as motors, solenoids, and any other actuator known in the art.

The drone package drop adapter 100 may also contain one or more sensors 240*a*, 240*b*, as illustrated in FIG. 3, such as photo eyes, weight sensors, capacitive sensors and similar that can detect if the drone package drop adapter 100 is blocked or clogged, for example by accumulated packages, debris, snow, ice, or similar. The sensors 240*a*, 240*b* may be connected to a user interface or alarm that can create an alert that the drone package drop adapter 100 needs to be serviced. For example, FIG. 3 illustrates an embodiment using sensors 240*a* that may be positioned at different locations to detect blockages, such as debris, stick packages, or others, on the ramps 122, 132, or shaft 170. This example illustrates the use of photo sensors 240*a* with reflectors 240*a*2 and beams 240*a*1, but other sensors that are known in the industry may be used. FIG. 3 also illustrates the use of a water level sensor 240*b* that may be used to detect if the water level in the collector compartments 150 is above a certain predetermined level which may indicate clogged drains or other problems.

As the figures are for exemplary purposes only and not meant to be limiting, the scope of the invention includes a body 110 to be of any shape, although the figures illustrate the body 110 to be of a general cube. Alternatively, the body 110 may be cylindrical, round, or any other shape. The terms "first side," "second side" and "bottom" are, in part, for orientation purposes. For example, if the body 110 is cylindrical, the first side 112 and second side 114 may be continuous, but the orientation of the first chute section 120, the second chute section 130 and the third chute section may be based upon the first side 112 and the second side 114.

Similarly, as the figures are exemplary and not meant to be limiting, the various chute sections may be have alternative configurations within the scope of the present invention. For example, referring to FIG. 4, the first chute section 120 is illustrated to have distinct parts including the first ramp 122, the first drop 124, the first connector 126, and the first secondary drop 128. Embodiments of the present invention include a first chute section 120 where the first drop 124, the first connector 126, and the first secondary drop 128 are one linear or curved element. Similarly, the second chute section 130 and the third chute section 140 may have embodiments with alternative configurations to the embodiments illustrated in the figures.

While the invention has been described with reference to exemplary embodiments, it will be understood by those skilled in the art that various changes, omissions, and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiments disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A drone package drop adapter comprising:
a body defining an interior;
a first chute section within the interior, wherein the first chute section comprises:
a first ramp, and
a first drop;
a second chute section within the interior, wherein the second chute section comprises:
a second ramp,
a second chute connector, and
a second drop;
an inlet; and,
a shaft;
wherein the first ramp has a plurality of first openings;
wherein the first ramp comprises:
a first ramp top edge, and
a first ramp bottom edge;
wherein the first drop comprises:
a first drop top edge, and
a first drop bottom edge;
wherein the first ramp bottom edge is attached to the first drop top edge;
wherein the second ramp has a plurality of second openings;
wherein the second ramp comprises:
a second ramp top edge, and
a second ramp bottom edge;
wherein the second chute connector comprises:
a second chute connector top edge, and
a second chute connector bottom edge;
wherein the second drop comprises:
a second drop top edge, and
a second drop bottom edge;
wherein the second ramp bottom edge is attached to the second chute connector top edge;
wherein the second chute connector bottom edge is attached to the second drop top edge;
wherein the first ramp is sloped downward from the first ramp top edge towards the second drop; and,
wherein the inlet and the shaft are formed between the first chute section and the second chute section.

2. The drone package drop adapter of claim 1, wherein the second ramp bottom edge extends towards the first ramp;
wherein the second ramp bottom edge extends over the first ramp; and,
wherein the second ramp bottom edge extends beyond the first ramp bottom edge.

3. The drone package drop adapter of claim 1:
wherein the body comprises:
a first side,
a second side, and
a bottom;
at least one collector compartment; and,
at least one drain,
wherein the first side is attached to the first ramp top edge;
wherein the first drop bottom edge is attached to the bottom;
wherein the second side is attached to the second ramp top edge;
wherein the second drop bottom edge is attached to the bottom;
wherein the at the least one collector compartment is formed between the first chute section, the first side and the bottom, and between the second chute section, the second side and the bottom; and,
wherein the at least one drain is in communication with the at least one collector compartment through the body.

4. The drone package drop adapter of claim 3 further comprising:
an aperture; and,
a package collection compartment;
wherein the shaft is in communication with the aperture;
wherein the aperture is in communication with the package collection compartment;
and, wherein the body is removably attached to the package collection compartment.

5. The drone package drop adapter of claim 4, wherein the package collection compartment comprises a plurality of positioning devices.

6. The drone package drop adapter of claim 3, wherein the body further comprises at least one access panel.

7. The drone package drop adapter of claim 1, wherein the second ramp is sloped downward from the second ramp top edge towards the first ramp.

8. The drone package drop adapter of claim 1 further comprising at least one mounting flange.

9. The drone package drop adapter of claim 1 further comprising a plurality of positioning devices.

10. The drone package drop adapter of claim 1 further comprising a location device.

11. The drone package drop adapter of claim 1 further comprises a trap door, wherein the trap door is hingedly attached to the shaft.

12. The drone package drop adapter of claim 1, wherein the first ramp further comprises a first ramp conveyor.

13. The drone package drop adapter of claim 1, wherein the second ramp further comprises a second ramp conveyor.

14. The drone package drop adapter of claim 1 further comprising at least one sensor.

15. The drone package drop adapter of claim 14, wherein the at least one sensor is a photosensor.

16. The drone package drop adapter of claim 14, wherein the at least one sensor is a water level sensor.

17. A drone package drop adapter comprising:

a body, wherein the body comprises:
- a first side,
- a second side, and
- a bottom;

a first chute section, wherein the first chute section comprises:
- a first ramp,
- a first drop,
- a first connector, and
- a first secondary drop;

a second chute section, wherein the second chute section comprises:
- a second ramp,
- a second connector, and
- a second drop;

a third chute section, wherein the third chute section comprises:
- a third ramp,
- a third connector, and
- a third drop;

at least one collector compartment;

an inlet; and, a shaft;

wherein the first ramp has a plurality of first openings;

wherein the first ramp comprises:
- a first ramp top edge, and
- a first ramp bottom edge;

wherein the first drop comprises:
- a first drop top edge, and
- a first drop bottom edge;

wherein the first connector comprises:
- a first connector top edge, and
- a first connector bottom edge;

wherein the first secondary drop comprises:
- a first secondary drop top edge, and
- a first secondary drop bottom edge;

wherein the first side is attached to the first ramp top edge;

wherein the first ramp bottom edge is attached to the first drop top edge;

wherein the first drop bottom edge is attached to the first connector top edge;

wherein the first connector bottom edge is attached to the first secondary top edge;

wherein the first secondary bottom edge is attached to the bottom;

wherein the first ramp is sloped downward from the first side towards the second side;

wherein the second ramp has a plurality of second openings;

wherein the second ramp comprises:
- a second ramp top edge, and
- a second ramp bottom edge;

wherein the second connector comprises:
- a second connector top edge, and
- a second connector bottom edge;

wherein the second drop comprises:
- a second drop top edge, and
- a second drop bottom edge;

wherein the third ramp has a plurality of third openings;

wherein the third ramp comprises:
- a third ramp top edge, and
- a third ramp bottom edge;

wherein the third connector comprises:
- a third connector top edge, and
- a third connector bottom edge;

wherein the third drop comprises:
- a third drop top edge, and
- a third drop bottom edge;

wherein the second side is attached to the second ramp top edge;

wherein the second ramp bottom edge is attached to the second connector top edge;

wherein the second connector bottom edge is attached to the second drop top edge;

wherein the second drop bottom edge is attached the third ramp top edge;

wherein the third ramp bottom edge is attached to the third connector top edge;

wherein the third connector bottom edge is attached to the third drop top edge;

wherein the third drop bottom edge is attached to the bottom;

wherein the third ramp is sloped downward from second side towards the first side;

wherein the at the least one collector compartment is formed between the first chute section, the first side and the bottom, and between the second chute section, the third chute section, the second side and the bottom; and, wherein the inlet and the shaft are formed between the first chute section, the second chute section and the third chute section.

18. The drone package drop adapter of claim 17, wherein the second ramp bottom edge extends towards the first side;

wherein the second ramp bottom edge extends over the first ramp; and, wherein the second ramp bottom edge extends beyond the first ramp bottom edge.

19. The drone package drop adapter of claim 17, wherein the first ramp bottom edge extends towards the second side;

wherein the first ramp bottom edge extends over the third ramp; and, wherein the first ramp bottom edge extends beyond the third ramp bottom edge.

20. The drone package drop adapter of claim 17 further comprising at least one drain, wherein the at least one drain is in communication with the at least one collector compartment through the body.

21. The drone package drop adapter of claim 17, wherein the second ramp is sloped downward from the second side towards the first side.

22. The drone package drop adapter of claim 17, wherein the second connector is sloped downward from the second ramp bottom edge towards the second side.

23. The drone package drop adapter of claim 17 further comprising at least one mounting flange.

24. The drone package drop adapter of claim 17 further comprising a plurality of positioning devices.

25. The drone package drop adapter of claim 17 further comprising:

an aperture; and, a package collection compartment;

wherein the shaft is in communication with the aperture;

wherein the aperture is in communication with the package collection compartment;

and, wherein the body is removably attached to the package collection compartment.

26. The drone package drop adapter of claim 25, wherein the package collection compartment comprises a plurality of positioning devices.

27. The drone package drop adapter of claim 17 further comprising a location device.

28. The drone package drop adapter of claim 17, wherein the body further comprises at least one access panel.

29. The drone package drop adapter of claim 17, wherein the third ramp is sloped downward from the second drop bottom edge towards the first side.

30. The drone package drop adapter of claim 17 further comprising a trap door, wherein the trap door is hingedly attached to the shaft.

31. The drone package drop adapter of claim 17, wherein the first ramp further comprises a first ramp conveyor.

32. The drone package drop adapter of claim 17, wherein the second ramp further comprises a second ramp conveyor.

33. The drone package drop adapter of claim 17, wherein the third ramp further comprises a third ramp conveyor.

34. The drone package drop adapter of claim 17 further comprising at least one sensor.

35. The drone package drop adapter of claim 34, wherein the at least one sensor is a photosensor.

36. The drone package drop adapter of claim 34, wherein the at least one sensor is a water level sensor.

* * * * *